US007392895B2

(12) United States Patent
Ottow et al.

(10) Patent No.: US 7,392,895 B2
(45) Date of Patent: Jul. 1, 2008

(54) AGITATING ELEMENT FOR DISCHARGING POORLY POURABLE BULK MATERIALS

(76) Inventors: Manfred Ottow, Walporzheimer Strasse 24, D-13465 Berlin (DE); Robin Ottow, Sperrstrasse 84, CH-4057 Basel (CH)

( * ) Notice: Subject to any disclaimer, the term of this patent is extended or adjusted under 35 U.S.C. 154(b) by 0 days.

(21) Appl. No.: 11/591,932

(22) Filed: Nov. 2, 2006

(65) Prior Publication Data

US 2007/0095632 A1 May 3, 2007

(30) Foreign Application Priority Data

Nov. 2, 2005 (DE) ..... 10 2005 052 621

(51) Int. Cl.
*B65G 65/16* (2006.01)

(52) U.S. Cl. ..... 198/550.6; 198/548; 198/550.1; 198/671

(58) Field of Classification Search ..... 198/545, 198/548, 549, 550.6, 550.1, 671; 222/413; 414/21, 326

See application file for complete search history.

(56) References Cited

U.S. PATENT DOCUMENTS 2,751,203 A * 6/1956 Compton ..... 299/56
3,685,638 A * 8/1972 Siwersson et al. ..... 198/608
3,949,863 A * 4/1976 Lippi ..... 198/666
4,275,808 A * 6/1981 Bullivant et al. ..... 198/533
4,324,495 A * 4/1982 Martinez ..... 366/271
4,351,627 A * 9/1982 Forsberg ..... 414/312
4,441,603 A * 4/1984 Baumard ..... 198/518
5,685,382 A * 11/1997 Deeter ..... 175/394
6,679,559 B2 * 1/2004 Kelm ..... 299/57
7,192,094 B2 * 3/2007 Kelm ..... 299/56

FOREIGN PATENT DOCUMENTS

DE 43 39 974 A1 6/1995
DE 197 06 407 C1 6/1998

* cited by examiner

*Primary Examiner*—Douglas A Hess
(74) *Attorney, Agent, or Firm*—Collard & Roe, P.C.

(57) ABSTRACT

In a method and a device for discharging poorly pourable bulk materials from a receptacle, the material is first rendered free-flowing via a helically shaped agitating element (worm conveyer) and secondly discharged from the receptacle via a spiral shaped agitation element (spiral conveyer). Both elements are mechanically coupled at their respective lose ends. The respective other ends of the agitating elements are attached to a common shaft. The shaft connects to a gear drive at its upper end which provides for the rotational movement of the two agitating agents. The rotation of the worm conveyor transports the material situated between the turns of the worm conveyer upward to the bulk material surface. This breaks up the bulk material. Material that has been brought up by the worm conveyer flows downward again due to the gravitational force. Some of the material flows back along the outer space around the worm conveyer while the other portion moves down through the center of the worm conveyer. Thus two circulating flows of bulk material are generated. The spiral conveyor rotating at the bottom of the receptacle sweeps the free flowing bulk material to the outlet opening for discharge from the receptacle.

6 Claims, 1 Drawing Sheet

Fig. A
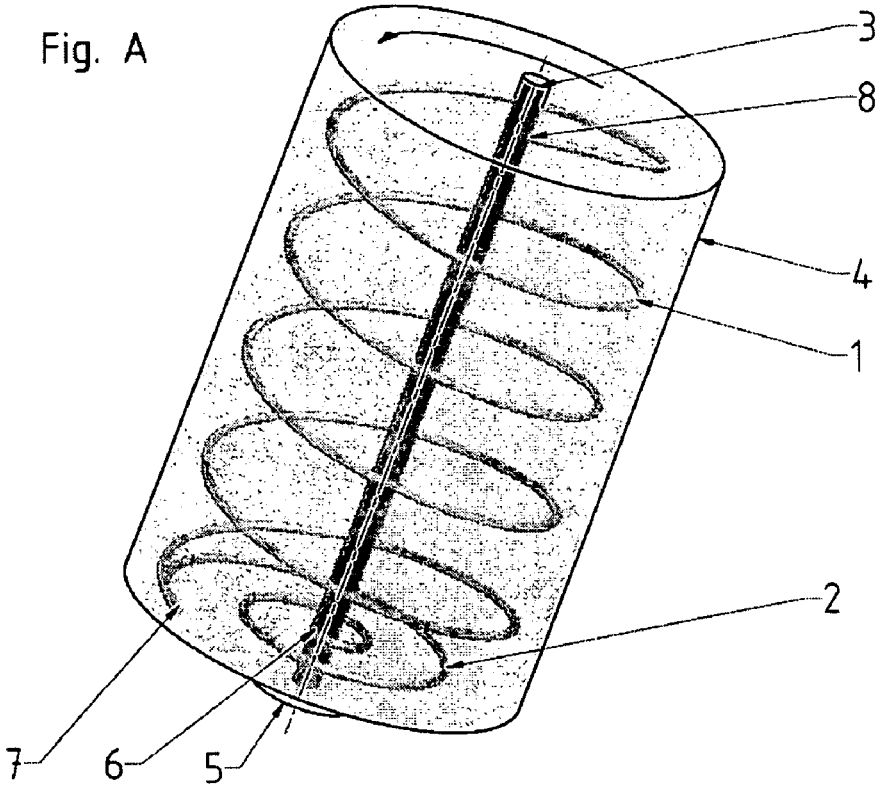
Fig. B
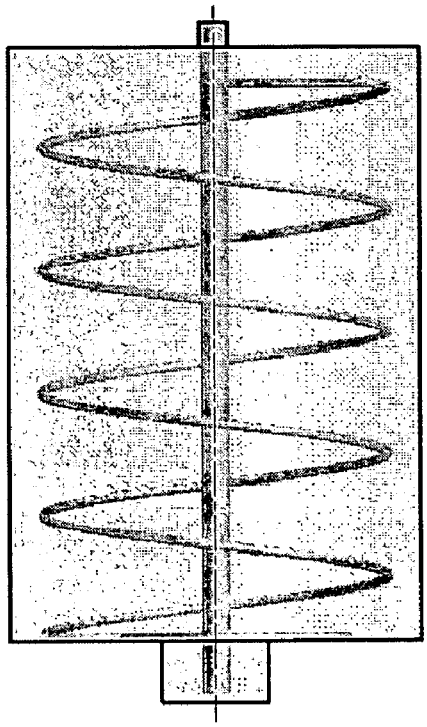

AGITATING ELEMENT FOR DISCHARGING POORLY POURABLE BULK MATERIALS

CROSS REFERENCE TO RELATED APPLICATIONS

Applicants claim priority under 35 U.S.C. §119 of German Application No. 10 2005 052 621.7 filed Nov. 2, 2005.

DESCRIPTION OF THE PRIOR ART

The invention pertains to a method and a device for discharging poorly flowing bulk materials such as, in particular, sawdust, splinters and wood chips from a receptacle.

In order to store bulk materials, receptacles are usually filled from the top and emptied through an outlet opening at the receptacle bottom. Bulk materials that interlock or have a poor pourability for other reasons show a steep angles of repose. Consequently such materials tend to bridge over the outlet opening and cannot be discharged from the receptacle without additional measures.

As prior art DE 197 06 407 C 1 describes a metering and discharging device for bulk materials, in which a stirrup-shaped agitator is arranged on a metering tube with a metering aperture. The bulk material flows into the metering tube through the metering aperture and is discharged from an outlet at the lower end of the metering tube. When processing poorly pourable bulk materials, the metering tube is set in rotation about the longitudinal axis such that the agitator breaks up the bulk material and the bulk material can be discharged through the metering aperture.

In this case, it is disadvantageous that the agitator is unable to separate individual bulk material particles from one another if they are more substantially entangled or interlocked. In such instances, the rotation of the agitator merely leads to a uniform rotational movement of the entire "block" of bulk material particles such that no bulk material is discharged from the receptacle.

As a further disclosure of prior art DE 43 39 974 A 1 shows a device for metering powdery bulk materials, in which an agitating element in the form of a screw-shaft discharges the bulk material from a funnel shaped reservoir. The quantity of bulk material to be metered can be varied in dependence on the rotational speed and the rotating direction of the screw-shaft. When using a screw shaft with a right-handed thread, a clockwise rotation of the shaft results in a high metering accuracy at a low throughput and a counterclockwise rotation results in a lower metering accuracy at a higher throughput.

However, this device is only suitable for powdery bulk material because this type of bulk material cannot interlock and form clumps. Due to their rough and cleaved surfaces, poorly pourable materials such as, e.g., splinters and wood chips tend to interlock and form clumps such that the screw-shaft is blocked.

SUMMARY OF THE INVENTION

Consequently, the invention is based on the objective of making available a method and a device for the discharge of poorly pourable bulk materials from a receptacle, in which the disadvantages of the state of the art in this respect are avoided.

With respect to the method, this objective is attained, according to the invention, by rendering the bulk material free-flowing in the receptacle via a first agitating element and discharged from the receptacle via a second agitating element. With respect to the device, this objective is attained by realizing the first agitating element in the form of a worm conveyor that is fixed on a shaft and the rotation of which forces the bulk material situated between the turns of the worm conveyer upward to the bulk material surface and by realizing the second agitating element in the form of a spiral conveyor that is fixed on a shaft and the rotation of which causes the broken up bulk material situated at the bottom of the receptacle to be transported to the outlet opening.

BRIEF DESCRIPTION OF THE DRAWINGS

FIG. A shows a perspective view of the invention.

FIG. B shows a side view of the invention.

Advantageous embodiments of the inventive method and device are discussed below.

DETAILED DESCRIPTION

According to the invention, a poorly pourable bulk material is rendered free-flowing by means of a first helical agitating element and discharged from the receptacle by means of a second helical agitating element. In this case, it is particularly advantageous to mechanically couple the first helical agitating element and the second helical agitating element to one another such that only one drive is required for both agitating elements.

The first agitating element consists of a shaft and a worm conveyor, and the second agitating element consists of a shaft and a spiral conveyor. The shafts of the first and the second agitating element in fact consist of the same shaft such that the worm conveyor and the spiral conveyor are fixed on only one shaft. In this case, it is particularly advantageous that only one shaft is required and that the space requirement can be reduced accordingly.

The spiral conveyor is fixed on the shaft in such a way that it is positioned above the bottom of the receptacle, particularly directly above the bottom. The worm conveyor also begins in the region of the receptacle bottom and ends, in particular, at a point above the highest possible product filling level, at which it is connected to the shaft.

The rotation of the worm conveyor causes the material situated between the turns of the worm conveyer upward to the bulk material surface. This breaks up the bulk material. The material brought up by the worm conveyer flows downward again due to the gravitational force, thus generating a circulating flow of the bulk material.

The rotation of the spiral conveyor causes the broken up bulk material to be transported to the outlet opening at the receptacle bottom, at which it is discharged from the receptacle. The inventive device is particularly suitable for emptying receptacles that are filled with sawdust and/or wood chips.

The invention is described in greater detail below with reference to an embodiment that is illustrated in figures A and B respectively. The figure schematically shows a specially shaped agitating element according to the invention.

According to figure A, the agitating element consists of a shaft 3, a worm conveyor 1 and a spiral conveyor 2. The spiral conveyor 2 is fixed on the shaft 3 in such a way 6 that it is positioned directly above the bottom of the receptacle 4 (See fig B) The worm conveyor 1 also begins at the receptacle bottom and ends at a point above the maximum product filling level, at which it is connected 8 to the shaft 3.

The rotation of the worm conveyor 1 causes the bulk material situated between the turns of the conveyer to be transported upward to the bulk material surface in the receptacle 4. This breaks up the bulk material. The material lifted up, flows back to the bottom of the receptacle due to the gravitational force and follows a path outside or inside the worm conveyer, respectively. Consequently, circuiting motions of the bulk material develop.

The rotation of the spiral 2 conveyor causes the broken up bulk material to be transported to the outlet opening 5 at the bottom of the receptacle, at which it is discharged from the receptacle.

LIST OF REFERENCE SYMBOLS

1 Worm conveyor
2 Spiral conveyor
3 Shaft
4 Receptacle
5 Outlet opening
6 Spiral conveyor connects to shaft 3
7 Worm conveyor connects to shaft 3
8 Tips of worm conveyor and of spiral conveyor connected

The invention claimed is:

1. A method for discharging poorly pourable bulk materials from a receptacle (4) with an outlet opening (5), wherein the bulk material is rendered free-flowing in the receptacle (4) by means of a first agitating element (1) and discharged from the receptacle (4) by means of a second agitating element (2), wherein the first agitating element (1) comprises a worm conveyor fixed (8) on a shaft (3) and the second agitating element (2) comprises a spiral conveyor fixed (6) on said shaft (3), wherein a rotation of the worm conveyor transports the material situated between turns of the worm conveyor upward to a surface of the bulk material, breaking up the bulk material, wherein the material that has been brought up to the surface of the bulk material by the worm conveyor flows downward again due to a gravitational force such that a first portion of the material flowing downward flows back along an outer space around the worm conveyor and a second portion of the material flowing downward moves down through a center of the worm conveyor, thereby generating two circulating flows of bulk material in the receptacle (4), and wherein a rotation of the spiral conveyor causes broken up bulk material situated at a bottom of the receptacle (4) to be transported to the outlet opening (5).

2. The method for discharging poorly pourable bulk materials according to claim 1, wherein the poorly pourable bulk material is selected from the group consisting of sawdust, splinters and wood chips and combinations thereof.

3. A device for discharging poorly pourable bulk materials from a receptacle (4) with an outlet opening (5), the device comprising a first agitating element comprising a worm conveyor (1) fixed on a shaft (3) and a second agitating element comprising a spiral conveyor (2) fixed on said shaft (3);

wherein a rotation of the worm conveyor causes the bulk material to move upwards as the worm conveyor rotates, wherein broken up bulk material moves down again toward a bottom of the receptacle (4) both outside and inside a coil of the worm conveyor and wherein the free flowing bulk material at the bottom of the receptacle (4) is caught by the spiral conveyor and swept towards the outlet opening (5) at the bottom of the receptacle (4).

4. The device for discharging poorly pourable bulk materials according to claim 3 wherein the spiral conveyor and the worm conveyor begin in the region of the bottom of the receptacle (4).

5. The device for discharging poorly pourable bulk materials according to claim 4, wherein the spiral conveyor (2) is fixed directly above the bottom of the receptacle (4).

6. The device for discharging poorly pourable bulk materials according to claim 3, wherein the worm conveyor (1) ends above the highest possible product filling level and is connected to the shaft (3) at this location.

* * * * *